US006463595B2

(12) United States Patent
Prisco et al.

(10) Patent No.: US 6,463,595 B2
(45) Date of Patent: Oct. 15, 2002

(54) TOILET VENTILATION SYSTEM

(75) Inventors: Anthony Prisco; Angelo Anthony Cassaro; Nicholas Vincent Montana, Sr., all of Las Vegas, NV (US)

(73) Assignee: Delpriss Management Services, Inc., Las Vegas, NV (US)

( * ) Notice: Subject to any disclaimer, the term of this patent is extended or adjusted under 35 U.S.C. 154(b) by 0 days.

(21) Appl. No.: 10/000,241

(22) Filed: Oct. 18, 2001

(65) Prior Publication Data

US 2002/0035749 A1 Mar. 28, 2002

Related U.S. Application Data

(63) Continuation of application No. 09/483,490, filed on Jan. 14, 2000, now abandoned.

(51) Int. Cl.[7] ..... E03D 9/04
(52) U.S. Cl. ..... 4/213
(58) Field of Search ..... 4/213, 352

(56) References Cited

U.S. PATENT DOCUMENTS 963,297 A * 7/1910 Kelly ..... 4/352
1,861,501 A * 6/1932 Lowther ..... 4/213
3,277,499 A * 10/1966 Keefauver ..... 4/213
3,733,619 A * 5/1973 Smith ..... 4/213 X
4,222,129 A * 9/1980 Baker ..... 4/213

* cited by examiner

*Primary Examiner*—Charles E. Phillips
(74) *Attorney, Agent, or Firm*—Weide & Miller, Ltd.

(57) ABSTRACT

A toilet ventilation system is disclosed. The system includes a manifold which is connectable to a toilet near an opening of a bowl thereof, and in one or more embodiments, a hollow toilet seat. The manifold has an inlet through which gasses may be drawn from the toilet area, at least one outlet, and a hollow interior through which gasses are routed from the inlet to the at least one outlet. The system also includes an elbow connected to the manifold at the outlet, an exhaust conduit connected to the elbow, and an air flow inducing element for drawing air from the toilet area through the manifold from its inlet to outlet and then through the elbow and exhaust conduit to an exhaust point. In one or more other embodiments, manifold has a bottom surface adjacent the inlet which slopes downwardly in the direction of the inlet, causing fluid which enters the inlet to drain back out of the inlet. Additionally, in one embodiment, the manifold includes at least one fluid flow prevention element for preventing the flow of liquid through the manifold from the inlet to the outlet. This fluid flow prevention element may comprise at least one wall extending upwardly from the bottom surface. The toilet seat includes one or more inlets or vents in a bottom surface leading through the seat to an outlet aligned with the inlet of the manifold, causing air to be drawn directly from the bowl area.

18 Claims, 5 Drawing Sheets

TOILET VENTILATION SYSTEM

RELATED APPLICATION DATA

This application is a continuation of U.S. application Ser. No. 09/483,490, filed Jan. 14, 2000 now ABN.

FIELD OF THE INVENTION

The present invention relates to systems and apparatus for ventilating toilets.

BACKGROUND OF THE INVENTION

Many systems have been devised in attempts to solve the problem of removing unpleasant odors from toilet areas. This problem has existed since before even the invention of the water-flush toilet.

In some systems, an entire room is ventilated with an exhaust fan. Such systems are quite inefficient at solving the unpleasant odor problem. Exhausting room air, typically from a ceiling location, requires the exchange of large quantities of air and does not necessarily protect occupants from unpleasant odors. This is particularly true in public restrooms and hotel bathrooms. Moreover, the exhausting of a sufficient quantity of room air to create an acceptably odor-free environment creates increased energy loads on buildings due to the influx of un-heated or un-cooled air from the outdoors.

Other systems have been devised for removing odors from the area of the toilet. Ventilating proximal to the source of the odorous emissions yields many benefits, including improved evacuation of odors before their dissemination into the general surroundings and energy savings in that the total volume of air which must be removed is lessened.

In general, none of the prior developed systems for removing odors directly at the toilet/source have been commercially unsuccessful. Upon scrutiny, these systems may have been commercially unsuccessful due to one or more drawbacks associated therewith. For example, some systems are extremely difficult or expensive to manufacture. Others are difficult to install. Some of the prior devices are incompatible with the variety of existing toilet configurations and designs.

Another problem is that many of the systems fail to meet applicable building, fire, plumbing or other codes or regulations. One particular problem is that when ventilating in the area of the toilet, it is desirable to draw air from very close to the toilet bowl. In many arrangements, however, the configuration of the system would permit liquid to be drawn into the system. This is not only undesirable, but in many instances violates local codes and regulations relating to the "flood rim level" of the toilet.

An improved toilet area ventilation system which overcomes the above-stated problems is desired.

SUMMARY OF THE INVENTION

The present invention comprises a toilet ventilation system. The system includes a manifold which is connected to a toilet near an opening of a bowl thereof. The manifold has an inlet through which gasses may be drawn from the toilet area, at least one outlet, and a hollow interior through which gasses are routed from the inlet to the at least one outlet. The system also includes an elbow member having a first end and a second end. The first end of the elbow is removably connectable to the manifold at an outlet and defines an exhaust path leading from the outlet. An exhaust conduit is connected to the second end of the elbow member. The exhaust conduit defines an exhaust path leading from the elbow member. An air flow inducing element draws gasses from an area adjacent the toilet through the inlet into the manifold to the outlet, through the outlet into the elbow member and through the exhaust conduit to an exhaust point.

In one or more embodiments, the manifold comprises a top portion and a bottom portion which are removably connected. The inlet of the manifold is centrally located, and plenums lead in opposing directions to outlets. In one embodiment, the elbow member is connected to one of the outlets and the other outlet is closed, such as with a cap member.

In one embodiment of the invention, the manifold includes at least one fluid flow prevention element for preventing the flow of liquid through the manifold from the inlet to the outlet. In one or more embodiments, this fluid flow prevention element comprises at least one wall extending upwardly from the bottom surface. In one or more other embodiments, the manifold has a bottom surface adjacent the inlet. The bottom surface slopes downwardly in the direction of the inlet, causing fluid which enters the inlet to drain back out of the inlet.

In one or more embodiments of the invention, the toilet ventilation system includes a specially configured toilet seat. The seat has at least one inlet in a bottom surface thereof and at least one outlet. In a down position, the outlet of the seat is aligned and communicates with the inlet of the manifold. Air is drawn from directly within the bowl into the seat and then into the manifold and on to the exhaust point.

One or more embodiments of the invention include a method of exhausting air from a toilet area and a method of installing a toilet ventilation system.

Further objects, features, and advantages of the present invention over the prior art will become apparent from the detailed description of the drawings which follows, when considered with the attached figures.

DETAILED DESCRIPTION OF THE INVENTION

Figure 1:
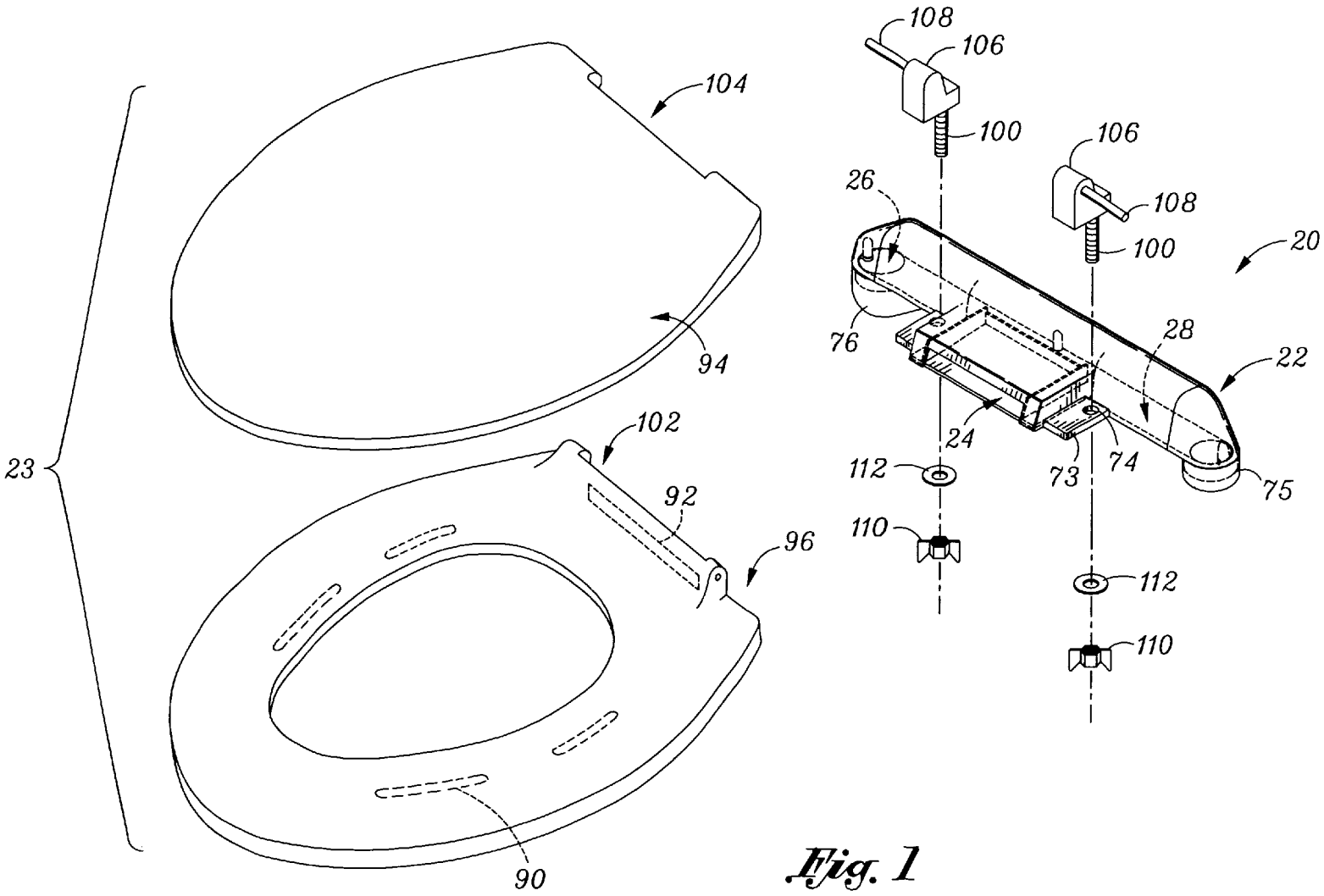
FIG. 1 is an exploded view of a toilet ventilation system in accordance with an embodiment of the invention including a toilet seat assembly and a manifold.

The invention is a toilet ventilation system. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention Toilet Ventilation System FIG. 1 illustrates a toilet ventilation system 20 in accordance with the present invention. In general, the system 20 comprises a manifold 22 and a toilet seat assembly 23. The manifold 22 has at least one inlet 24 and at least one outlet 26, an exhaust pathway 28 leading from the outlet 26 of the manifold 22, and at least one apparatus for causing air to flow from a toilet area into the inlet 24 of the manifold 22 and therethrough to the outlet 26 and then through the exhaust pathway 28 to an exhaust point. The toilet seat assembly 23 is arranged to cooperate with the manifold 22, having at least one inlet 90 through which air may flow from within a bowl area of the toilet, and at least one outlet 92 through which air drawn into the seat assembly 23 is exhausted to the inlet 24 of the manifold 22.

Figure 4:
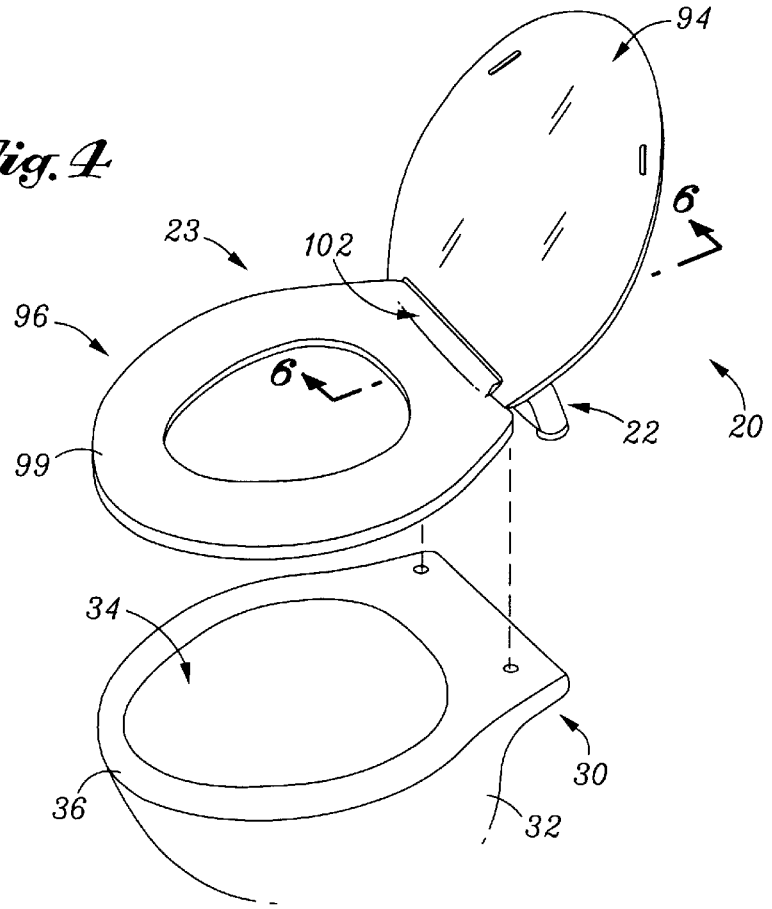
FIG. 4 is a perspective view of the toilet seat assembly and connected manifold in relation to a toilet bowl with which the system of the invention may be utilized.
Figure 5:
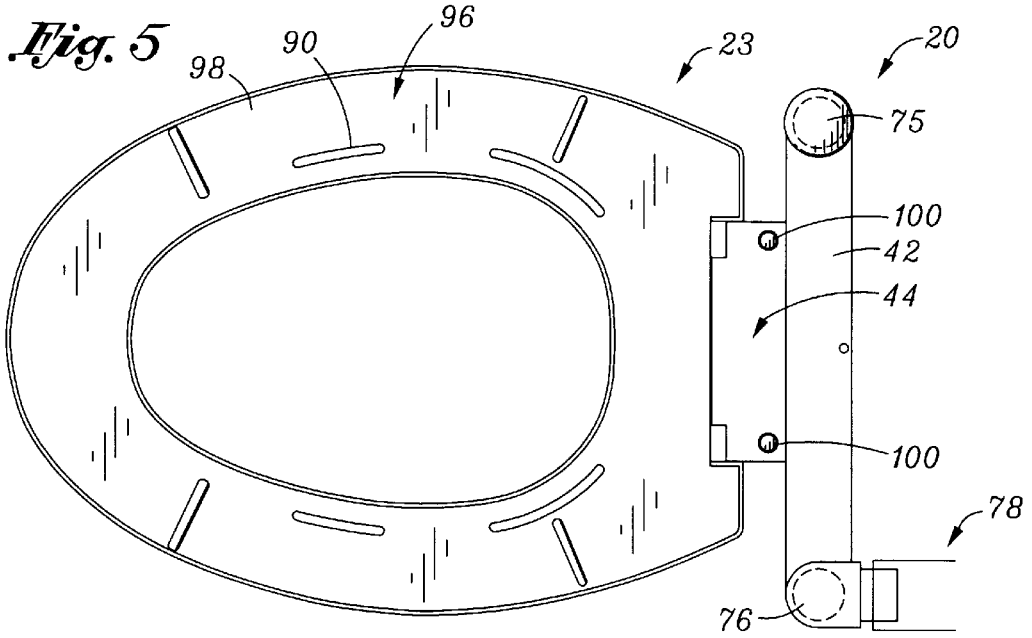
FIG. 5 is a bottom view of the toilet seat assembly and connected manifold illustrated in FIG. 4.
Figure 6:
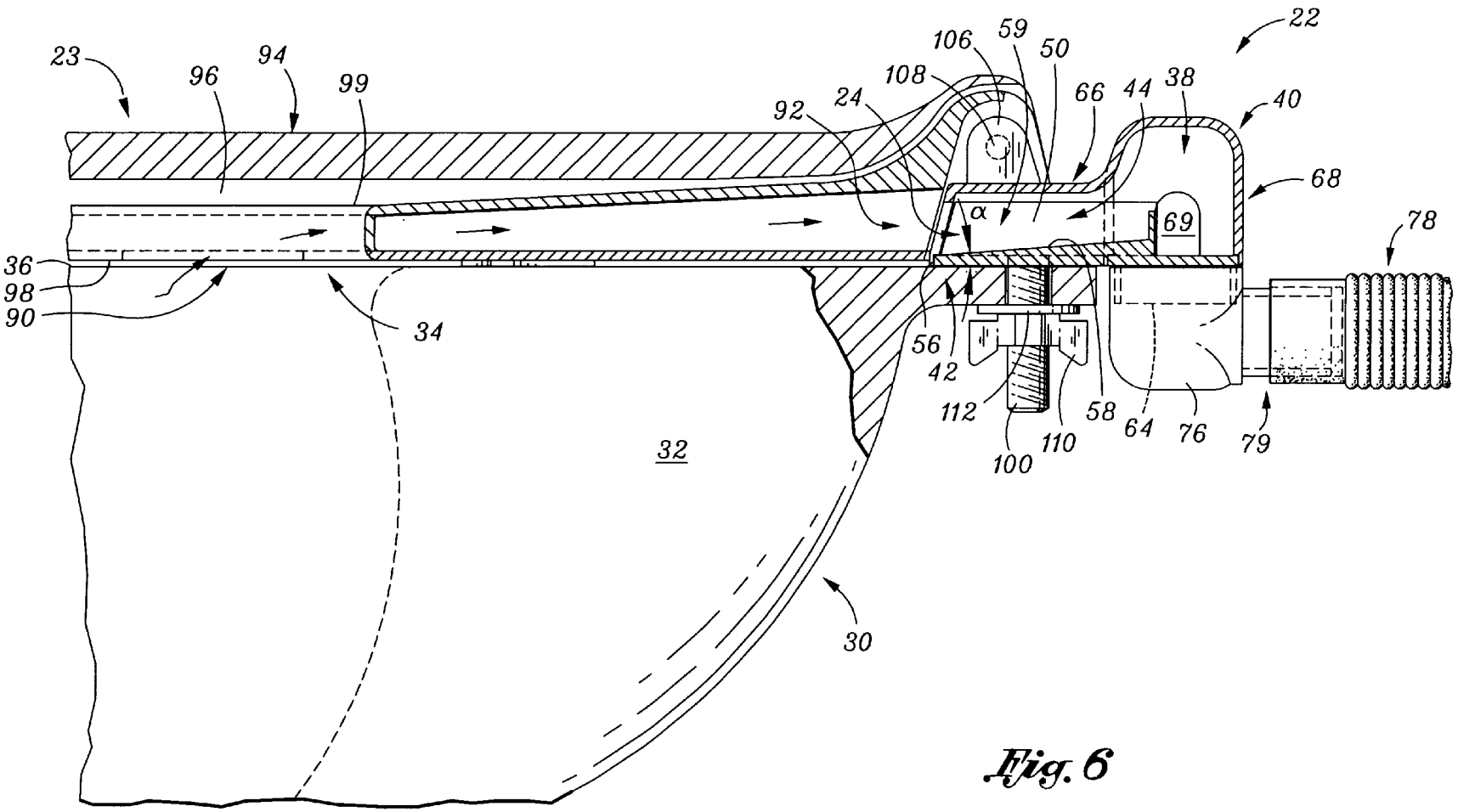
FIG. 6 is a cross-sectional view of the toilet seat assembly and connected manifold illustrated in FIG. 4 once installed on the toilet, taken along line 6—6 therein.

The system 20 is adapted for use with a wide variety of toilets. Referring to FIGS. 4 and 6, the system 20 is illustrated in combination with a water-flush type toilet 30 having a bowl 32 defining an opening 34. The bowl 32 has a generally flat top surface 36 between the opening 34 and a water tank (not shown). The construction and operation of such toilets 30 are well known and as such is not be described in detail herein. As will be appreciated, the system 20 of the invention can be used with toilets 30 having a wide variety of configurations other than that illustrated. For example, the system 20 may be used with tank-less toilets.

Figure 2:
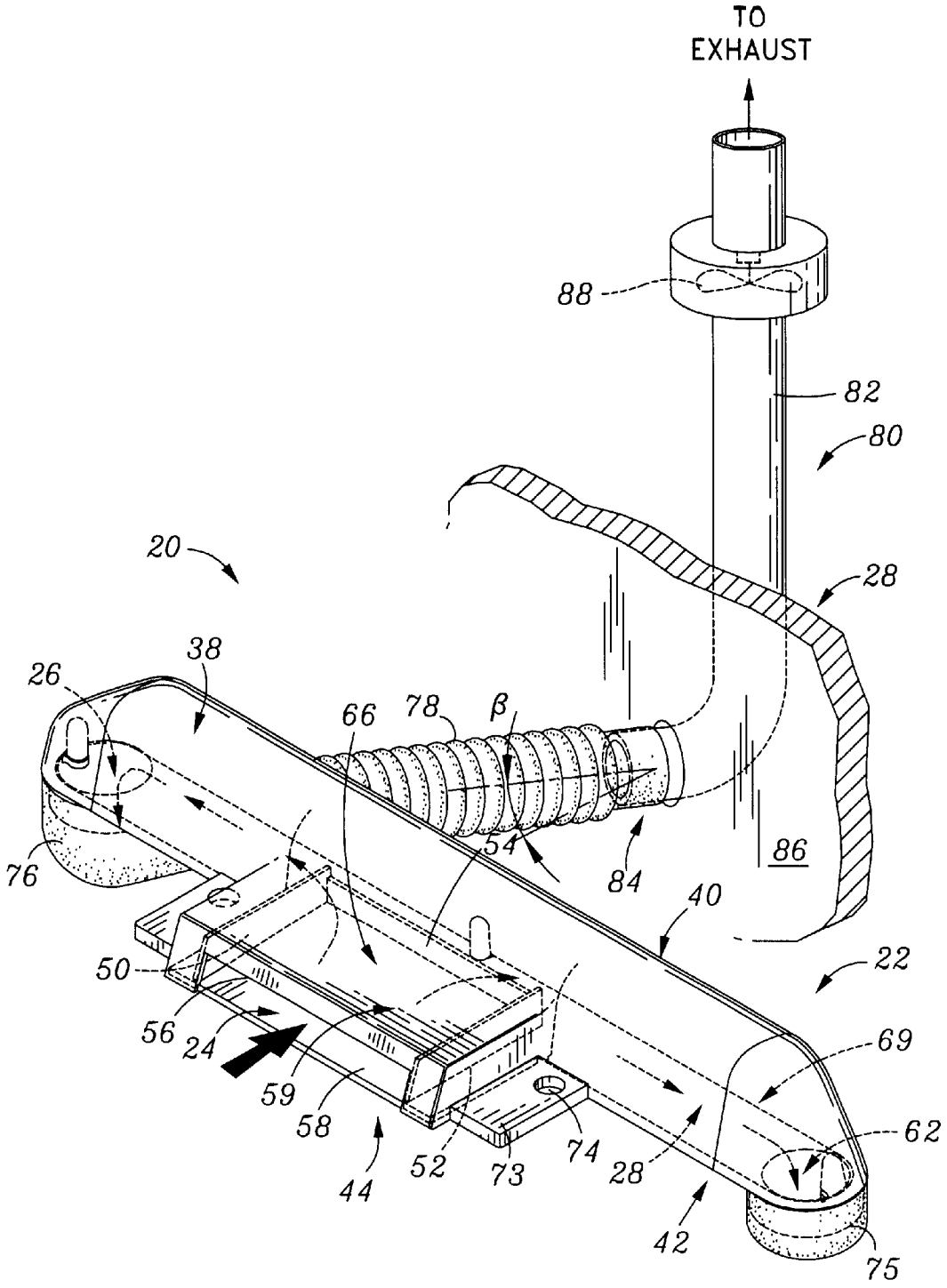
FIG. 2 is a perspective view of the manifold portion of the system, illustrated installed.
Figure 3:
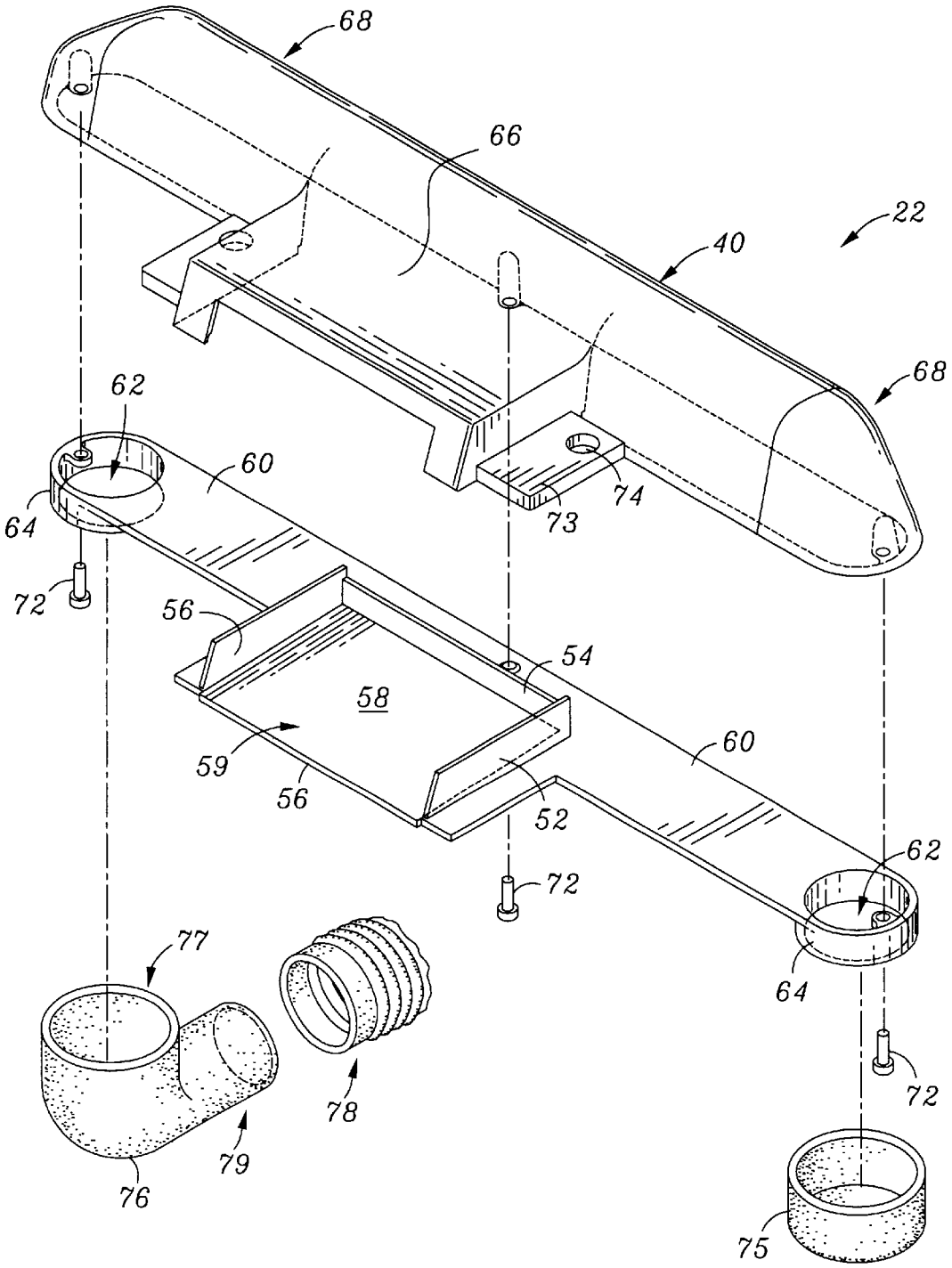
FIG. 3 is an exploded view of a manifold portion of the ventilation system illustrated in FIG. 1.

An embodiment of the invention will now be described in more detail. Referring first primarily to FIGS. 2, 3 and 6, the system 20 includes a ventilation manifold 22. In general, the manifold 22 is arranged to guide air from an area near the toilet 30 and route it to an exhaust path. The manifold 22 is adapted for positioning on the flat surface 36 of the toilet bowl 32. The manifold 22 has at least one inlet 24 through which gasses and the like are drawn. These gasses are routed through an interior area 38 of the manifold 22 to the at least one outlet 26.

Referring to FIG. 3, in one or more embodiments, the manifold 22 comprises a top portion 40 and a bottom portion 42. In general, the bottom portion 42 of the manifold 22 generally comprises a relatively thin plate-like member. The bottom portion 42 includes a central section 44. At least that portion of a bottom surface of the bottom portion 40 in the area of the central section 44 is generally flat for abutting or resting on the generally flat surface 36 of the toilet bowl 30. The central section 44 has a front portion which defines a portion of the inlet 24, as described in detail below.

One or more fluid flow prevention elements or means are associated with the manifold 22 for preventing fluid, namely liquid, from flowing through the manifold 22. In one embodiment, the fluid flow prevention means comprise first, second and third side walls 50,52,54 extending upwardly from the top surface 45 of the bottom portion 42 at the central section 44. The first and second of the walls 50,52 are spaced apart and extend from a front edge 56 of the central section 44 rearwardly to the third wall 54. The third wall 54 extends generally perpendicular to the first and second walls 50,52. These walls 50,52,54 surround an inlet bottom surface 58 and generally define an intake chamber 59 (see also FIG. 6).

Referring to FIG. 6, in one or more embodiments the fluid flow prevention means also includes a sloping inlet bottom surface 58. In accordance with this embodiment, the inlet bottom surface 58 slopes upwardly when moving in the direction of the front edge 56 towards the third wall 54. In the embodiment illustrated, the slope a of the inlet bottom surface 58 is approximately 4.5 degrees.

Referring again to FIG. 3, a pair of arms 60 extend outwardly in opposing directions from a rear part of the central section 44 of the bottom portion 42 of the manifold 22. An opening 62 is provided in an end portion of each arm 60 opposite the central section 44. One or both openings 62 comprise the outlets 26 of the manifold 22.

An exhaust path connection element or member is associated with each opening. In one or more embodiments, each connection element comprises a nipple 64 extending downwardly from the bottom surface 46 of the bottom portion 42 at each opening 62. Each nipple 64 comprises a generally circular, tapered wall. The outer diameter of each wall comprising the nipples 42 is smaller at its end opposite the manifold 22 than at its connection point to the manifold 22. As described below, this configuration for each nipple 64 permits a slip-fit connection of an elbow or like fitting onto the nipple 42.

The top portion 40 of the manifold 22 is arranged to mate with the bottom portion 42. So mated, the top and bottom portions 40,42 define the inlet 24 and the enclosed hollow interior 38 through which gasses may flow from the inlet 24 to the at least one outlet 26.

The top portion 40 is generally concave when viewed from its bottom side. The top portion 40 has a central section 66 and arms 68 corresponding to those of the bottom portion 42.

Referring to FIG. 3, the central section 66 of the top portion 40 is arranged to fit over and enclose the central section 44 of the bottom portion 42, except at the front edge 56 of the bottom portion 42, where the inlet 24 is defined. Referring to FIGS. 3 and 6, an interior top surface of the central section 66 of the top portion 40 is vertically higher than a top of the walls 50,52,54 which extend upwardly from the bottom portion 42. As described in more detail below, this permits gasses flowing through the inlet 24 into the intake chamber 59 to flow over the top of one or more of the walls 50,52,54 into the interior 38 of the manifold 22.

The arms 68 of the top portion 40 cooperate with the arms 60 of the bottom portion 42 to define enclosed elongate pathways or plenums 69 leading from the intake chamber 59 (see FIGS. 2 and 6). These plenums 69 lead to each of the openings 62 in the bottom portion 42 of the manifold 22.

To provide an aesthetically pleasing appearance, in one or more embodiments, the top portion 40 of the manifold 22 is designed to accept the bottom portion 42. Referring to FIG. 6, in one arrangement, a portion of the lower edge 70 of the top portion 40 is recessed for accepting the bottom portion 42 therein. In this arrangement, the manifold 22 does not appear to be constructed from multiple elements, but as a single member, creating a visually appealing effect. Because the manifold 22 is constructed of top and bottom portions 40,42 however, it is easier to construct.

Means are provided for removably securing the top and bottom portions 40,42 of the manifold 22 to one another. In the embodiment illustrated in FIG. 2, this means comprises at least one threaded fastener 72 which extends through the bottom portion 42 of the manifold 22 upwardly into engagement with the top portion 40. Because of the elongate nature of the arms 60,68, in one or more embodiments, at least one fastener 72 is used to fasten the top and bottom portions 40,42 near each opening 62. In addition, at least one fastener 72 is used to connect the central sections 44,66 of the top and bottom portions 40,42. As may be appreciated, a number of other means may be used to removably connect the top and bottom portions 40,42. Such means may comprise, but are not limited to clips, bolts, snaps, etc.

Referring to FIG. 3, a flange 73 extends outwardly from each side of the outside of the central section 66 of the top portion 40. Each flange 73 has an aperture or passage 74 therein. The positions of the flanges 73 and apertures 74 are arranged to facilitate the passage of mounting bolts 100 for mounting the manifold 22 and associated seat assembly 23 as described in much greater detail below.

In one or more embodiments, means are provided for routing gasses from the inlet 24 of the manifold 22 through at least one of the openings 62 to an exhaust point. As described below, this means for routing comprises a closed exhaust path 28.

Referring to FIG. 2, in a preferred arrangement, a cap 75 is placed over one of the nipples 64 for closing the opening 62 with which it is associated. The opening 62 which is capped is advantageously chosen to be that opening 62 which is most readily visible when considering the toilet with which the system 20 is associated. For example, when the system 20 is associated with a toilet 30 positioned so that one side thereof is visible when entering a bathroom, the opening 62 at that side of the system 20 is capped or closed. Of course, the element which is used to close the opening 62 may comprise other than a cap 75, such as a plug or the like.

In one or more embodiments, the means for routing includes an elbow member 76 associated with the nipple 64 of the opening 62 which is not capped. The elbow member 76 is arranged to re-direct the flow of exhaust from a generally vertical direction to a generally horizontal direction. As best illustrated in FIG. 3, the elbow member 76 is asymmetric. A first portion 77 of the member 76 which is arranged to engage the nipple 64 is short in relation to a second portion 79 which extends outwardly from the manifold 22. In this arrangement, the profile of the member 76 in the vertical direction below the manifold 22 is small, making the member 76 less visible.

Those of skill in the art will appreciate that one or both of the cap 75 and elbow member 76 may be formed integrally with the manifold 22. However, the arrangement by which these elements are separate permits the installer to customize the installation of the system 20, as described in more detail below.

In one or more embodiments, the means for routing also includes a conduit element 78 leading from the elbow member 76 to an exhaust passage 80. As illustrated, the conduit element 78 comprises a flexible hose. In one or more embodiments, the exhaust passage 80 comprises a pipe 82 having a first end 84 which extends through a wall 86 adjacent the toilet 30. A second end of the pipe (not shown) leads to an exhaust point, such as a point outside of a house or building.

In one or more embodiments of the invention, the first end 84 of the pipe 82 extends through the wall 86 at a point generally behind the toilet 30. This makes the pipe 82 less visible. In this arrangement, it is desirable for the pipe 82 to extend at an angle $\beta$ of approximately 45 degrees from the plane of the wall. In addition, the elbow member 76 extends towards the center of the toilet 30 at an angle of 45 degrees. This makes the elbow member 76 less visible. The alignment of the pipe 82 and member 76 at a 45 degree angle makes the exhaust conduit 78 easy to install between the pipe 82 and elbow member 76.

The system 20 includes a means for drawing gasses from the toilet area through the manifold 22, then through the elbow 76 to a point remote from the toilet 30. A number of such means are well known and they may be arranged in a variety of configurations. In one or more embodiments, the means comprises a fan 88 or similar air-flow inducing element associated with the exhaust pipe 82. The fan 88 may be located in a number of areas and may be of a variety of types and sizes dependent on the particular installation. For example, a larger capacity fan 88 may be required when venting from an interior bathroom through a long exhaust path, as compared to an arrangement where venting is through just a wall behind the toilet.

In one or more embodiments of the invention, one or more components of the system 20 are constructed of a durable plastic. For example, the top and bottom portions 40,42 of the manifold 22, the cap 75 and the elbow member 76 may be molded from ABS or similar plastic.

In one or more embodiments of the invention, each plenum 69 through the manifold 22 has a diameter of at least about 1 inch. Each opening 62 is at least one inch in diameter, and the inner diameter of the conduit 78 and at least the first end 84 of the pipe 82 is 1 inch. In one or more embodiments, the inside diameter of the portion of pipe 82 positioned inside of the wall 86 is 1.5 inches. It should be appreciated that other dimensioned components may be used, but considering frictional losses and a desired flow rate, a different fan 88 may then be required.

In the embodiment illustrated, the inlet 24 of the manifold 22 comprises a single, generally rectangular opening. In one or more embodiments, the inlet 24 is about 3.5 inches wide and 0.5 inches high. Those of skill in the art will appreciate that the inlet 24 may comprise multiple openings and may have a variety of shapes and sizes. In general, the shape and size of the inlet 24 are chosen so that maximum flow rate and area is achieved for drawing gasses from the region of the toilet bowl opening 32.

As illustrated in FIG. 1, the inlet 24 is defined by the bottom surface 58 of the intake area of the bottom portion 42 of the manifold 22 and two upwardly extending sides and a top comprising a portion of the top portion 40 of the manifold. The inlet 24 could be formed in other fashions, such as entirely as a part of the bottom portion 42 of the manifold 20. In this regard, it is also noted that the manifold 22 may be constructed as a single element or from more than two portions. When formed from two portions, the two portions can be shaped differently than as illustrated.

The distance from the center of the manifold 22 to each opening 62 is approximately 6 inches. This distance is sufficient for the manifold 22 to span most toilets from side to side, permitting the positioning of the elbow 76 and cap 75.

In one or more embodiments, the manifold 22 may be arranged with only a single plenum 69 extending to one side. Then the manifold 22 only includes a single outlet 26. In one or more embodiments, the outlet 26 may also be positioned other than as described above. For example, if the toilet 28 is of the type which does not include a water tank positioned directly behind the bowl 30, the outlet 26 may be positioned in general alignment with the inlet 24 and be arranged for connection with an exhaust passage leading generally horizontally outward from the manifold 22 directly behind the manifold 22. In one or more embodiments, the outlet 26 may be arranged to connect with a special exhaust passage formed in and leading through the toilet 28, such as a passage having an entrance in the top surface 32 of the bowl 30 and which leads to a point exterior to the bowl. In that instance, the outlet 26 may be positioned behind the inlet 24, but be arranged to interface with the exhaust passage through the toilet 28. In another embodiment, the outlet 26 may be arranged to connect with a passage leading through or below a tank portion of the toilet 28.

The fluid flow prevention elements may be other than the walls 50,52,54 and the sloping surface 58. While adapted to prevent the flow of liquid through the manifold 22, however, the fluid flow prevention element(s) should not substantially interfere with the flow of gaseous matter through the manifold 22. For example, the manifold 22 may be arranged so that the inlet 24 leads to a generally closed inlet chamber, the chamber having a slot or similar aperture which is positioned above a lower surface of the chamber, the slot leading to the one or more plenums through the manifold 22. The fluid flow prevention element(s) may comprise passages leading through the manifold 22 from the inlet 24 having lower surfaces which are generally higher than that of the inlet, and where the tubes slope in the direction of the inlet.

It should be appreciated that the means for routing exhaust from the manifold 22 may comprise other than the elbow 76, conduit 78 and pipe 80 as described above. For example, a conduit 78 maybe connected directly to the manifold 22 at the opening 62. In addition, a rigid pipe may be positioned between the manifold 22 and the exhaust pipe 80. The above-described arrangement has advantageous of being both visually appealing and easy to install, as described in more detail below.

The manifold 22 as described above is useful with a variety of toilet seats, including those commonly used today on most toilets. Preferably, the manifold 22 is used with a specially configured toilet seat assembly 23 as described below and illustrated in FIGS. 1 and 4–6.

Referring to FIG. 1, the toilet seat assembly 23 generally has two components: a lid 94 and a seat 96. The lid 94 may be of a variety of shapes and sizes, such as those well known in the art. In general, the lid 94 comprises a solid oval-shaped member. As described below, the lid 94 is moveable between a raised position in which the seat 96 is exposed, and a lowered position for covering the seat 96.

The seat 96 may also be of a variety of shapes and sizes. As illustrated, the seat 96 has the form of an elongate closed ring defining a central opening. With respect to both the lid 94 and seat 96, it is noted that toilets 30 have a wide variety of shapes, such as round and oval, with the lids 94 and seats 96 for use therewith generally being similarly shaped. The seat 96 need not form a closed ring but may be of the open-front type commonly found in public restrooms. In one or more embodiments, the lid 94 may be omitted entirely (such as is common in public facilities).

The seat 96 has a bottom surface 98 and a top surface 99. Located in the bottom surface 98 is at least one inlet or vent 90. As illustrated, four inlets 90 are provided in pairs of two in opposing portions of the seat 96. The inlets 90 lead to at least one outlet 92 via one or more passages 106. In the preferred arrangement, the outlet 92 is provided at a rear portion of the seat 96.

In one or more embodiments, the seat 96 comprises two elements connected to one another: a generally flat base and a top portion defining a recessed bottom area. When the flat base is connected to or fitted within the bottom of the top portion, the two elements form a generally hollow seat 96. In such an arrangement, the inlets 90 are formed in the base portion and the outlet 92 is formed in a rear portion of the top portion. In one or more embodiments, the outlet 92 is formed in a rear part of an upwardly extending lip 102. In such an arrangement, the lid 94 preferably includes a recessed area 104 in which the lip 102 of the seat 96 extends when the seat assembly 23 is mounted.

In one or more embodiments, each inlet 90 has the shape of an elongate slit. In this fashion, air is drawn into the seat 96 over a wide area of the toilet 30. The inlets 90 may comprise a number of other elements, such as a plurality of small circular holes or the like. Preferably, the outlet 92 is generally rectangular in shape, being approximately the same size as the inlet 24 of the manifold 22. The outlet 92 may comprise more than one opening.

The seat 96 and lid 94 may be constructed from a wide variety of materials, such as ABS. In a preferred arrangement, the lid 94 and seat 96 are constructed from a polymer material in a molding process.

As detailed above, mounting bolts 100 or similar fasteners are provided for mounting the seat assembly 23 to the toilet bowl 30. As described below, the specific mounting arrangement of the invention has numerous purposes and advantages.

Referring to FIG. 1, each mounting bolt 100 is associated with a mount 106. A pin 108 extends from the mount 106 generally perpendicular to the bolt 100. In one or more embodiments, the mount 106 is a molded plastic element. As illustrated in FIG. 6, the mount 106 is shaped (when viewed from the side) similar in contour to the upwardly extending lip 102 of the seat 96.

The lid 94 and seat 96 are pivotally mounted on the pins 108. As illustrated, the mounts 106 are arranged so that the pins 108 face in opposite directions. The lid 94 and seat 96 are both provided with pairs of passages into which the pins 108 extend.

As illustrated in FIG. 6, the pins 108 are positioned, the mounts 106 shaped, and the passages 74 through the flanges 73 of the manifold 22 precisely located, such that when the seat 96 is in a "down" position, the outlet 92 thereof is in close or abutting relationship with the inlet 24 of the manifold. On the other hand, the arrangement still permits both the lid 94 and seat 96 to move freely between their raised or up position and lowered or down position.

The seat assembly 23 may be mounted for movement with respect to, but still attached to, the manifold 22 in a number of other ways. For example, a double hinge may be connected to the mount 106 and the lid 94 and seat 96, respectively.

Method of Installation/Configuration

One aspect of the invention is a method for installing a ventilation system 20. First, the top and bottom portions 40,42 of the manifold 22 are connected, such as with the fasteners 72.

The manifold 22 and the seat assembly 23 are simultaneously secured to the toilet 30 using the mounting bolts 100. As illustrated in FIGS. 1 and 6, the bolts 100 are passed through the apertures 74 in the flanges 73 of the manifold 22 and through aligned passages in the toilet bowl 32. A wing-nut 110 or similar element may be placed on the free end of each bolt 100 to tighten the assembly into a fixed position. A washer 112 may be provided between the nut 110 and toilet 30 for distributing the applied force to prevent chipping and cracking of the bowl 30.

An advantage of this arrangement is that one single set of fasteners can be used to mount the entire system to the toilet 30. In addition, the manifold 22 is securely positioned in the desired location for drawing gasses directly from the toilet area. As described above, the described arrangement is such that the mounts 106 maintain (via the pins 108 and bolts 100) the seat assembly 23 and manifold 22 in a specific relationship. This relationship is such that when the seat 96 is in its down position, the outlet 92 thereof is aligned with and adjacent the inlet 24 of the manifold. Because the manifold 22 and seat assembly 23 are connected by the mounts 106, movement of the manifold 22 or seat assembly 23 will not cause a shift in position which might alter this desired configuration (for example, the seat 96 can not be twisted or moved relative to the manifold 22 such that over time the outlet 90 of the seat 96 and inlet 24 of the manifold 22 would move out of alignment). As may be appreciated, the close relationship of the manifold inlet 24 and seat outlet 92 minimizes any air flow suction losses in the system, ensuring that maximum air is drawn from the bowl area through the inlets 90 of the seat 96.

Once the manifold 22 is secured, the elbow member 76 and cap 75 are connected to the appropriate nipples 64. As described above, it is desirable to cap 75 the opening 62 associated with the end of the manifold 22 which is most readily visible. The cap 75 and elbow member 76 are easily and securely connected by slipping each of them over their associated tapered nipple 64.

The conduit 78 is then installed between the elbow member 76 and the first end 84 of the exhaust pipe 82. In one or more embodiments, the conduit 78 is slipped over the second end 79 of the elbow member 76 and over the first end 84 of the exhaust pipe 82. In this installation, it is assumed that the exhaust pipe 82, fan 88 and the like are already installed. Of course, the fan 88 may be located in a wide variety of locations, and the exhaust pipe 80 need not be positioned in a wall.

Toilet Ventilation System Operation and Features

The operation of the toilet ventilation system 20 will now be described with reference to the figures. First, the fan 88 or other means for inducing a flow of gasses is made operational. A flow of gasses is then induced. As best illustrated in FIG. 6, this flow is from the toilet area 30 through the inlets 90 of the seat 96, through the seat to the outlet 92 thereof, and then into the inlet 24 of the manifold 22. These gasses then flow through the inlet 24 and into the hollow interior 38 thereof. The gasses flow over the walls 50,52,54 of the bottom portion 42 of the manifold 22 and into the plenum 69 through the manifold 22 leading to the un-plugged opening 62. The gasses then flow through the opening 62, through the elbow member 76, the conduit 78, and then the exhaust pipe 82 to the exhaust point.

The toilet ventilation system 20 of the invention has numerous advantages. In the event the water level in the toilet bowl 32 rises excessively, water is prevented from entering the manifold 22 and being drawn therethrough. In addition, splashed water is prevented from entering the manifold 22 and being drawn therethrough. This features is a result of the sloped bottom surface 46 and the walls 50,52,54. The walls 50,52,54 serves as "dikes" preventing water from flowing through the manifold 22. In addition, any fluid which flows into the manifold 22 will eventually flow back out of the inlet 24 through the force of gravity along the sloped bottom surface 46.

The arrangement of the inlet 24 has the advantage of making the manifold 22 easy to clean. Cleaner may be sprayed into the inlet 24. The cleaner will remove deposits of material and the like and then flow back out of the inlet 24 to the toilet bowl 30.

The entire manifold 22 may be disassembled for cleaning if necessary. This is accomplished by unhooking the conduit 78, removing the manifold 22 from the toilet 30, and then separating the top and bottom portions 40,42 by removing the fasteners 72.

The system 20 has the advantage of being effective in removing odorous emissions at their source, without undue energy consumption and other inefficiencies associated with whole-room exhaust systems and the like. The system 20 is also arranged to meet applicable codes, including addressing "flood rim level" code issues. In particular, the walls 50,52, 54 provide an air intake point which is higher than the top surface 36 of the toilet bowl 30 by a distance such that water, if overflowing the bowl, will not be drawn into the system 20.

The assembly of the seat assembly 23 and manifold 22 is arranged so that close alignment thereof is maintained over time. This ensures maximum air flow from the bowl area.

The configuration of the system 20 is also aesthetically appealing. As will be appreciated, bathrooms and the fixtures therein are closely scrutinized by their users. In order for any odor/gas removing system to be considered acceptable for use, regardless of its efficiency, the system must be pleasing to the purchaser and user. Prior systems have suffered from this problem. In the present case, the seamless appearance of the manifold and its integration with the seat assembly, along with the configuration of the exhaust path from the manifold, renders the system 20 almost unnoticeable to the user of a toilet 30 with which the system is associated.

It will be understood that the above described arrangements of apparatus and the method therefrom are merely illustrative of applications of the principles of this invention and many other embodiments and modifications may be made without departing from the spirit and scope of the invention as defined in the claims.

We claim:

1. A manifold for a toilet ventilation system, said manifold having an inlet through which gas may flow into said manifold and at least one outlet through which gas may pass from said manifold, at least one passage extending through the manifold connecting the inlet and at least one outlet, said inlet in communication with an interior portion of said manifold, said interior portion having a bottom surface, a portion of said bottom surface adjacent said inlet sloping downwardly in a direction towards said inlet, and including spaced first and second wall members extending upwardly from said sloping surface and extending from said inlet into said interior portion of said manifold, and including a third wall member extending upwardly from said bottom surface, said third wall member extending between said first and second wall members in said interior portion of said manifold, said first, second and third wall members cooperating to define a fluid flow prevention element which inhibits the flow of liquid upwardly along said sloping surface from said inlet to said at least one outlet and direct said liquid back towards said at least one inlet, and wherein said interior portion of said manifold includes a top surface, said top surface positioned above a top edge of at least said third wall member, whereby gas flowing into said inlet may flow over said third wall to said at least one outlet.

2. The manifold in accordance with claim 1 wherein said manifold comprises a top portion and a bottom portion which are selectively connected to one another, said first, second and third wall members extending upwardly from said bottom portion.

3. The manifold in accordance with claim 2 wherein said top portion generally defines a top of said manifold and said bottom portion generally defines a bottom of said manifold, said top portion extending over said first, second and third wall members.

4. The manifold in accordance with claim 1 wherein said first and second wall members extend generally parallel to one another in a direction away from said inlet into said interior portion of said manifold, and wherein said third wall member extends generally perpendicular to said first and second wall members.

5. The manifold in accordance with claim 1 wherein said portion of said bottom surface which slopes upwardly is located in an area bounded by said inlet and said first, second and third walls.

6. The manifold in accordance with claim 1 wherein said first and second walls extend upwardly a greater distance than said third wall.

7. A toilet ventilation system for a toilet comprising:

a manifold adapted to be placed upon a toilet bowl and adjacent a tank thereof, said manifold comprising a top portion and a bottom portion which are selectively connectable, said top and bottom portions cooperating to define an interior space, said bottom portion defining a bottom surface of said interior space, said bottom surface being generally planar, and said top portion defining a top surface of said interior space, said top and bottom portions defining an inlet through which gas may be drawn and said bottom portion defining at least one outlet through which gas may pass, said manifold including a wall extending upwardly from said bottom surface, said wall defining a perimeter around said inlet within said interior space, said bottom surface within said perimeter sloping upwardly from said inlet, and a connection member extending downwardly from said bottom portion of said manifold at said outlet whereby gas may be drawn from said bowl of said toilet into said inlet and through said interior space to said at least one outlet and fluid drawn into said inlet is inhibited by said wall from flowing from said inlet to said at least one outlet;

an elbow member having a first end and a second end, said first end extending vertically into connection with said connection member at said outlet and defining an exhaust path therethrough leading from said outlet so said second end, extending generally horizontally;

an exhaust conduit connected to said second end of said elbow member, said exhaust conduit defining an exhaust path therethrough leading from said elbow member; and means for drawing air from an area adjacent said toilet through said at least one inlet into said manifold to said at least one outlet, through said outlet into said elbow member and through said exhaust conduit to an exhaust point.

8. The toilet ventilation system in accordance with claim 7 wherein a pair of flanges extend outwardly from said top portion of said manifold, each of said flanges having an aperture therethrough for accepting a mounting bolt for a toilet seat of said toilet.

9. The toilet ventilation system in accordance with claim 7 wherein said manifold has a central section with a front and a rear and at least one arm extending from said central section, said inlet located at said front of said central section and said at least one outlet located at an end of said arm opposite said central section, and wherein said wall includes opposing first and second portions extending rearwardly from either side of said inlet at said front of said central section.

10. The toilet ventilation system in accordance with claim 8 wherein said wall includes a third portion connecting said first and second portions inwardly from said front of said central section.

11. The toilet ventilation system in accordance with claim 8 wherein said top portion extends over said wall.

12. The toilet ventilation system in accordance with claim 8 wherein said connection member comprises a generally circular flange extending outwardly from said bottom surface of said bottom portion of said manifold, said connection member having an outer diameter at a location adjacent said bottom portion which is greater than an outer diameter at a location distal thereto.

13. A manifold for location on a toilet behind a bowl thereof, said manifold including a plate-like bottom portion, said bottom portion defining a bottom surface of said manifold, said bottom portion having a central section and a pair of arms extending in opposing directions from said central section, said central section having a front and a rear, said manifold including a top portion for mating to said bottom portion for defining a generally enclosed interior space, said top portion cooperating with said bottom portion to define an inlet at said front of said central section of said bottom portion through which gas may be drawn, and said bottom portion including an outlet leading from each arm, a first wall extending upwardly from said bottom portion, said first wall extending rearwardly from said front of said central section, a second wall extending upwardly from said bottom portion, said second wall extending rearwardly from said front of said central section, said first wall and second wall generally defining opposing sides of said inlet, a third wall extending upwardly from said bottom portion rearwardly of said front of said central section, said third wall extending between said first and second walls, said bottom surface sloping downwardly from said third wall to said inlet between said first and second walls, and said top portion having an inner surface which is located above at least one of said walls rearwardly of said front of said central section of said bottom portion, whereby gas drawn into said manifold through said inlet passes to said interior space and thereon to at least one of said outlets, and whereby fluid drawn into said manifold is inhibited from flowing beyond said first, second and third walls and drains back to said inlet along said sloping bottom surface.

14. The manifold in accordance with claim 13 where an elevation of said bottom surface at a location of said outlets at said arms is lower than an elevation of said bottom surface which slopes downwardly towards said inlet at said third wall.

15. The manifold in accordance with claim 13 wherein said third wall extends generally perpendicular to said first and second walls.

16. The manifold in accordance with claim 13 wherein a pair of flanges extend outwardly from said top portion at either side of said inlet, said flanges including at least one aperture for accepting a toilet seat mounting bolt.

17. The manifold in accordance with claim 13 wherein said third wall extends generally parallel to an axis along which said arms extend.

18. The manifold in accordance with claim 13 where said bottom surface of said bottom portion in an area rearwardly of said third wall is at an elevation which is lower than an elevation of said bottom surface which slopes downwardly towards said inlet at an opposing side of said third wall.

* * * * *